US005402858A

United States Patent [19]

Quantz et al.

[11] Patent Number: 5,402,858

[45] Date of Patent: Apr. 4, 1995

[54] O-RING SEAL FOR ROCK BIT BEARINGS

[75] Inventors: Wayne C. Quantz, Kingwood; Michael E. Hooper, Spring; Madapusi K. Keshavan, The Woodlands; Mark J. Hommel, Houston, all of Tex.

[73] Assignee: Smith International, Inc., Houston, Tex.

[21] Appl. No.: 212,013

[22] Filed: Mar. 11, 1994

[51] Int. Cl.[6] ..... E21B 10/24; F16C 33/78

[52] U.S. Cl. ..... 175/371; 175/372; 175/228; 384/94; 277/96.2

[58] Field of Search ..... 175/371, 372, 228; 384/94; 277/96.2, 96, 92, DIG. 6

[56] References Cited

U.S. PATENT DOCUMENTS 4,194,795 3/1980 Rife ..... 277/92 X
4,344,629 8/1982 Oelke ..... 175/371 X
4,554,985 11/1985 Backlund ..... 175/371
4,557,609 12/1985 Moren ..... 384/94
4,588,309 5/1986 Uyehara et al. ..... 175/371 X
5,099,519 4/1991 Tatum ..... 175/372 X

*Primary Examiner*—Stephen J. Novosad
*Attorney, Agent, or Firm*—Christie, Parker & Hale

[57] ABSTRACT

An improved O-ring seal for rock bit bearings is formed from a resilient elastomeric composition comprising a multiplicity of low friction wear resistant particles distributed uniformly throughout the composition. The low friction wear resistant particles can have a rounded or non-rounded configuration. The low friction wear resistant particles located near the surface of the O-ring are exposed through wear of the elastomeric component to form wear pads that contact adjacent rotating rock bit sealing surfaces. The wear pads serve to reduce the break-off friction between the adjacent sealing surfaces and minimize the occurrence of stick-slip, thereby enhancing the service life of the O-ring seal and rock bit.

13 Claims, 1 Drawing Sheet

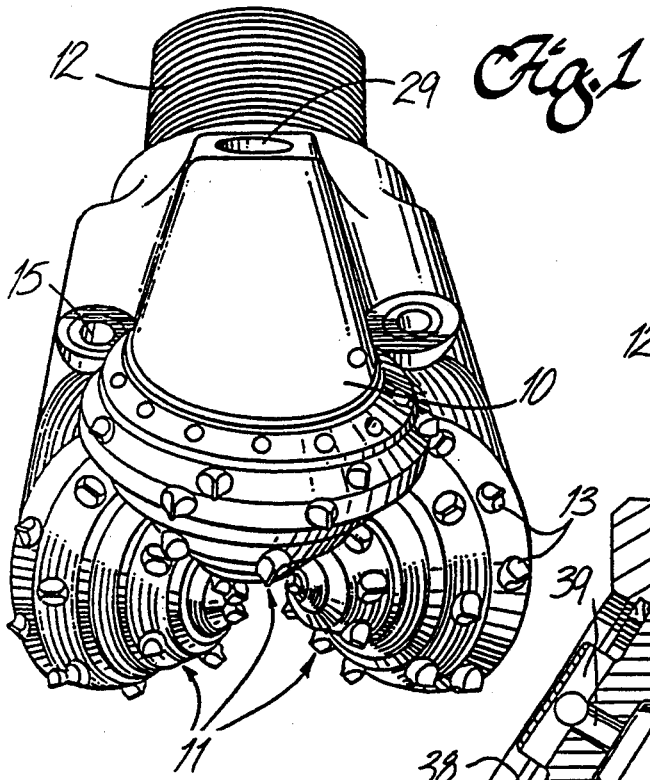
Fig. 1
Fig. 2
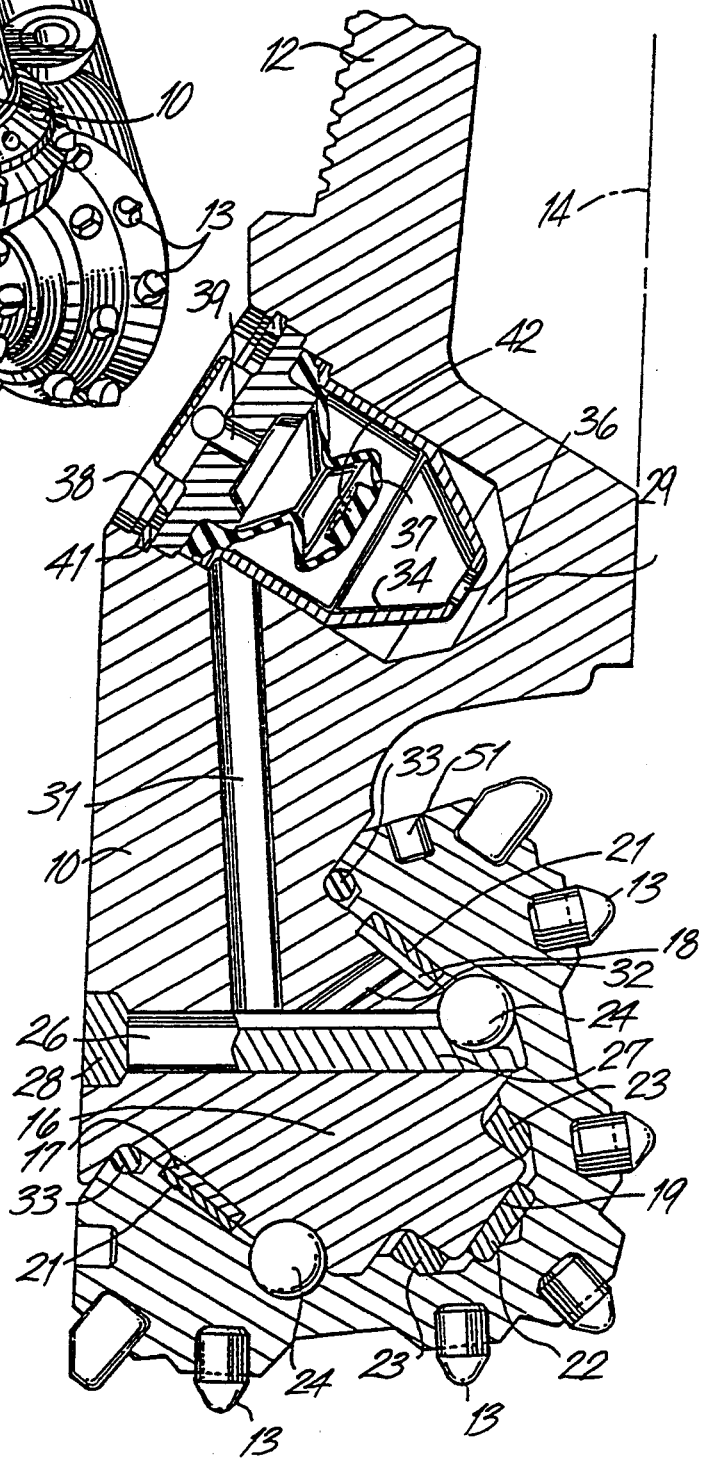

O-RING SEAL FOR ROCK BIT BEARINGS

FIELD OF THE INVENTION

This invention relates to an O-ring seal for retaining the lubricant around the journal bearings in a rock bit or drill bit for drilling oil wells or the like. More particularly, this invention relates to an O-ring seal comprising a surface having enhanced properties of reduced break-off friction that minimizes the occurrence of stick-slip, enhancing the service life of the O-ring seal and rock bit.

BACKGROUND OF THE INVENTION

Heavy-duty drill bits or rock bits are employed for drilling wells in subterranean formations for oil, gas, geothermal steam, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled. As such a rock bit is used for drilling in hard, tough formations, high pressures and temperatures are encountered.

The total useful life of a drill bit in such severe environments is in the order of 20 to 200 hours for bits in sizes of about 6½ to 12¼ inch diameter at depths of about 5,000 to 20,000 feet that are operated at about 200 rpm. Useful lifetimes of about 65 to 150 hours are typical. However, the useful life of drill bits that are operated at higher revolutions such as 375 rpm, i.e., high-speed drill bits, is generally in the range of from about 20 to 50 hours. The shortened useful life is often due to the increased frictional heat produced in the bit caused by the increased operating speed.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One reason for replacing the rock bits include failure or severe wear of the journal bearings on which the cutter cones are mounted. These bearings are subject to high pressure drilling loads, high hydrostatic pressures in the hole being drilled, and high temperatures due to drilling, as well as elevated temperatures in the formation being drilled. Considerable development work has been conducted over the years to produce bearing structures and to employ materials that minimize wear and failure of such bearings.

The journal bearings are lubricated with grease adapted to such severe conditions. Such lubricants are a critical element in the life of a rock bit. A successful grease should have a useful life longer than other elements of the bit so that premature failures of bearings do not unduly limit drilling. Failure of lubrication can be detected by generation of elevated pressure in the bit, evidence of which can often be found upon examination of a used bit. The high pressure is generated due to decomposition of the oil in the grease, with consequent generation of gas when lubrication is deficient and a bearing overheats due to friction. Lubrication failure can be attributed to misfit of bearings or O-ring seal failure, as well as problems with a grease.

Pressure and temperature conditions in a drill bit can vary with time as the drill bit is used. For example, when a "joint" of pipe is added to the drill string, weight on the bit can be relieved and slight flexing can occur. Such variations can result in "pumping" of the grease through O-ring seals, leading to loss of grease or introduction of foreign abrasive materials, such as drilling mud, that can damage bearing surfaces. One of the consistent problems in drill bits is the inconsistency of service life. Sometimes bits are known to last for long periods, whereas bits which are apparently identical operated under similar conditions may fail within a short lifetime. One cause of erratic service life is failure of the bearings. Bearing failure can often be traced to failure of the seal that retains lubricant in the bearing. Lubricant may be lost if the seal fails, or abrasive particles of rock may work their way into the bearing surfaces, causing excessive wear.

Rock bit O-rings are being called on to perform service in environments which are extremely harsh. Modern bits are being run at exceptionally high surface speeds, sometimes more than 500 feet per minute, with cone speeds averaging in the range of from 200 to 400 revolutions per minute. One face of the O-ring is exposed to abrasive drilling mud. The life of the O-ring may be significantly degraded by high temperatures due to friction (as well as elevated temperature in the well bore) and abrasion.

In order to provide a consistently reliable O-ring seal for maintaining the lubricant within rock bits, it is known to make the O-ring seal from a resilient elastomeric composition displaying a desire degree of chemical resistance, heat resistance, and wear resistance. O-ring seals known in the art are constructed from resilient elastomeric materials that, while displaying some degree of chemical, heat, and wear resistance, ultimately limited the service life of the rock bit by wearing away along the surface during use.

It is therefore desirable to provide a consistently reliable O-ring seal for maintaining the lubricant within a rock bit, that has a long useful life, is resistant to crude gasoline and other chemical compositions found within oil wells, has high heat resistance, is highly resistant to abrasion, has a low coefficient of friction against the adjacent seal surfaces to minimize heating and wear, and that will not readily deform under load and allow leakage of the grease from within the bit or drilling mud into the bit.

SUMMARY OF THE INVENTION

There is, therefore, provided in practice of this invention an improved O-ring seal for rock bit bearings. A first embodiment of an improved O-ring seal comprises a body formed from a highly-saturated nitrile (HSN) resilient elastomeric composition. The HSN elastomeric composition further comprises a multiplicity of low friction wear resistant particles distributed uniformly throughout the elastomeric composition. The particles may have a rounded or non-rounded, i.e., angular, configuration.

The low friction wear resistant particles may be selected from the group of materials including soft metals, hard metals, ceramic-metal composites, and ceramics. Preferred low friction wear resistant materials include titanium carbide, tungsten carbide, silicon carbide, cubic boron nitride, diamond, and diamond-like graphite. A preferred low friction wear resistant particle has an average particle size in the range of from about 0.001 to 0.2 millimeters (0.0001 to 0.01 inches). A particularly preferred elastomeric O-ring seal composition comprises in the range of from 10 to 15 parts by weight of the low friction wear resistant particles per 100 parts by weight of the elastomeric composition.

The O-ring seal comprises a body and surface formed from the elastomeric material and low friction wear resistant particle matrix. The O-ring surface is subjected to stick-slip by rotational contact with an adjacent sealing surface, causing material loss of the elastomeric component at the O-ring surface. The loss of the elastomeric component exposes the adjacent sealing surfaces to the low friction wear resistant particles, which form wear pads along the surface to isolate and protect the elastomeric material from further stick-slip related loss. In this manner the wear resistant particles help to minimize material loss from occurring at the O-ring surface, extending the life of the O-ring and the rock bit.

BRIEF DESCRIPTION OF THE DRAWINGS

A rock bit containing an O-ring seal constructed according to the principles of this invention is illustrated in semi-schematic perspective in FIG. 1 and in partial cross-section in FIG. 2.

DETAILED DESCRIPTION

A rock bit employing an O-ring seal constructed according to principles of this invention comprises a body 10 having three cutter cones 11 mounted on its lower end, as shown in FIG. 1. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

O-ring seals are generally thought of as comprising a cylindrical inside diameter, outside diameter, and a cylindrical cross section. Accordingly, for purposes of reference and clarity, the figures used to describe the principles and embodiments of this invention have been created to illustrate an O-ring seal having a generally circular cross section. However, the principles of this invention are also meant to apply to O-ring seals having non-cylindrical cross sections, such as an elliptical cross section and the like. Therefore, it is to be understood that the principles of this invention may apply to O-rings having a circular or non-circular cross sections.

FIG. 2 is a fragmentary, longitudinal cross-section of the rock bit, extending radially from the rotational axis 14 of the rock bit through one of the three legs on which the cutter cones 11 are mounted. Each leg includes a journal pin extending downwardly and radially, inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the exemplary journal bearings illustrated herein. It is to be understood that an O-ring seal constructed according to principles of this invention may be used with rock bits comprising either roller bearings or conventional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place. The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of an O-ring 33 between the cone and journal pin. Preferably, the O-ring is in a slightly V-shaped groove.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the O-ring seal 33 and permit drilling mud or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the O-ring seal. Even with a pressure compensator, it is believed that occasional differential pressures may exist across the O-ring of up to ±150 psi (548 kilopascals).

To maintain the desired properties of the O-ring seal at the pressure and temperature conditions that prevail in a rock bit, to inhibit "pumping" of the grease through the O-ring seal, and for a long useful life, it is important that the O-ring seal be resistant to crude gasoline and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Therefore, it is desired that the O-ring seal have a modulus of elasticity at 100 percent elongation of from 850 to 1275 psi (6 to 9 megapascals), a minimum tensile strength of 2300 psi (16 megapascals), elongation of from 200 to 350 percent, die C tear strength of at least 250 lb/in. (4.5 kilogram/millimeter), durometer hardness Shore A in the range of from 75 to 85, and a compression set after 70 hours at 100° C. of less than about 18 percent and preferably less than about 16 percent.

A variety of O-rings seals have been employed in such rock bits. Such O-rings typically comprise acrylonitrile polymers or acrylonitrile/butadiene copolymers. Other components in the polymers are activators or accelerators for the curing, such as stearic acid, and agents that add to heat resistance of the polymer, such as zinc oxide and curing agents. However, these synthetic rubbers typically exhibit poor heat resistance and become brittle at elevated temperatures after extended periods of time. Additionally, such compounds often exhibit undesirably low tensile strength and high coefficients of friction. Such properties are undesirable for a seal in a rock bit, since the high operating temperatures of the bit result in frequent failure of the seal.

Preferred O-ring seals can be formed from the group of elastomeric compositions including fluoroelastomers, carboxylated elastomers such as carboxylated nitriles, and highly saturated nitrile (HSN) elastomers and the like. A particularly preferred O-ring seal is made from an HSN resilient elastomer material and is disclosed in U.S. patent application Ser. No. 07/884,657 that is assigned to the same assignee as the present invention and is hereby incorporated by reference. An exemplary elastomeric composition may comprise per 100 parts by weight of highly-saturated nitrile elastomer, furnace black in the range of from 40 to 70 parts by weight, peroxide curing agent in the range of from 7 to 10 parts by weight, graphite in the range of from 10 to 20 parts by weight, zinc oxide or magnesium oxide in the range of from 4 to 7 parts by weight, stearic acid in the range of from 0.5 to 2 parts by weight, and plasticizer up to about 10 parts by weight.

A mechanism of failure in a rock bit O-ring may be characterized as stick-slip. As the elastomer of the O-ring moves along the metal surface of the leg or cone, the O-ring material momentarily sticks to the metal surface. Almost instantly the elastomer then slips relative to the metal. This making and breaking of bonds between the elastomer and metal dissipates energy and causes frictional heating. Furthermore, if too strong a bond is formed between the elastomer and metal, some of the elastomer may be removed from the O-ring, thereby degrading the surface.

It is therefore desirable to minimize the amount of sticking between the elastomer and metal. Such sticking is minimized in practice of this invention by modifying the surface of the O-ring without changing the bulk properties of the main body of the O-ring.

In elastomeric materials the tensile modulus of the elastomer, its tear strength and hardness are positively correlated. When the hardness of the elastomer is increased, one normally finds that the modulus and tear strength are also increased. Hardness is therefore a convenient means for comparing the properties of elastomers. For a rock bit O-ring, it is desirable that the durometer hardness of the O-ring is in the range of from about 75 to 85 on the Shore A scale. Typically, the hardness of the O-ring is about 80 Shore A. A hardness as high as 85 may result in premature failure of an O-ring at the same squeeze. Typically, in a rock bit, the squeeze of the O-ring in the seal is from about 7.5 to 10.5 percent, preferably toward the high end of the range for reliable sealing. It is desirable to maintain a squeeze in about this range and a bulk hardness in the order of 78 to 83, but to also increase the surface hardness and hence modulus and tear strength.

An O-ring seal constructed according to principles of this invention comprises a body and a surface both formed from an elastomeric composition of the type previously described. The HSN elastomeric composition further comprises a multiplicity of particles of low friction wear resistant materials which are uniformly distributed throughout the elastomeric composition forming an elastomeric low friction particle matrix. The particles can be rounded of high and/or low sphericity, or can be non-rounded or angular. Rounded particles are preferred because their interaction with an adjacent sealing surface is believed to be less abrasive than non-rounded or angular particles. The low friction wear resistant particles are added to the elastomeric composition to enhance the wear resistance of and reduce friction at the surface of the O-ring seal.

Suitable low friction wear resistant particles may be selected from group of materials including soft metallic materials such as copper, bronze, brass and the like, or hard metallic materials such as nickel, cobalt or the like, or ceramic-metal composite materials such as cemented tungsten carbide, titanium carbide and the like, or may be selected from groups of ceramic materials such as cubic boron nitride, diamond, diamond-like graphite, silicon carbide and the like. A particularly preferred low friction wear resistant material is titanium carbide. It is desired that the average particle size of the selected wear resistant material be in the order of from about 0.001 to 0.2 millimeters (0.0001 to 0.01 inches).

The O-ring seal is constructed by combining low friction wear resistant particles with the elastomeric material and mixing the combination together until the low friction wear resistant particles are uniformly distributed throughout the composition. A preferred elastomeric composition comprises in the range of from 10 to 15 parts by weight of the wear resistant particles per 100 parts by weight of the elastomeric composition. The O-ring seal is formed and cured the same as when the wear resistant particles are not present.

The completed O-ring seal is placed into position in the rock bit with the seal surface in contact with respective surfaces of the cone and the journal. As the cone is rotated on the journal, the surface of the O-ring seal is subjected to friction caused by the rotation on the adjacent journal pin surface (a rock bit O-ring typically stays stationary relative to the cone and slides relative to the journal pin). The friction causes the surface of the O-ring seal to heat and undergo stick-slip, causing the rubber or elastomeric component of the O-ring seal to wear away. As the elastomeric component of the seal surface continues to wear, the entrapped particles of the low friction wear resistant material begin to bear against the rotating surface of the journal pin, forming wear pads that serve to isolate the elastomeric component of the O-ring seal surface from contact with an adjacent sealing surface. This serves to both minimize the occurrence of the "sticking" portion and maximize the "slipping" portion of the stick-slip phenomena between the O-ring surface and an adjacent sealing surface because the low friction wear resistant particles, and not the relatively higher friction elastomeric component, are contacting the adjacent sealing surface. The O-ring seal does this while maintaining a small sealing gap to prevent excessive leakage. The reduction of stick-slip serves to reduce material loss from the surface of the O-ring seal and, thus extends the service life of the O-ring seal and rock bit.

The friction between the wear resistant particles at the surface of the O-ring seal and the adjoining surface of the journal pin has been shown to be approximately one-half of the friction of the elastomeric component against the journal pin. Accordingly, the frictional heating occurring at the surface of the O-ring seal is effectively reduced by at least one-half through the incorporation of the low friction wear resistant particles, extending the service life of the seal and the rock bit. The low friction wear resistant particles are not only resistant to frictional or stick-slip related material loss caused by rotation against adjacent sealing surfaces but are also resistant to abrasive wear caused by exposure of the O-ring surface to drilling fluid.

Although, limited embodiments of an improved O-ring seal for rock bit bearings have been described and illustrated herein. Many modifications and variations will be apparent to those skilled in the art. Accordingly, it is to be understood that within the scope of the appended claims, the improved O-ring seal for rock bit bearing according to principles of this invention may be embodied other than as specifically described herein.

What is claimed is:

1. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body portion and a surface portion both formed from a resilient elastomeric composition and a multiplicity of low friction wear resistant particles uniformly distributed within the composition, the surface engaging a journal pin and cone.

2. The rotary cone rock bit as recited in claim 1 wherein the O-ring seal comprises an array of the low friction wear resistant particles exposed at the surface by wear of the elastomeric composition.

3. The rotary cone rock bit as recited in claim 1 wherein the elastomeric composition comprises a nitrile rubber.

4. The rotary cone rock bit as recited in claim 1 wherein the particles of low friction wear resistant material are rounded or non-rounded.

5. The rotary cone rock bit as recited in claim 1 wherein the particles of low friction wear resistant material are selected from the group consisting of soft metals, hard metals, ceramic-metal composites, and ceramics.

6. The rotary cone rock bit as recited in claim 5 wherein the particles of low friction wear resistant material are selected from the group of materials consisting of titanium carbide, tungsten carbide, silicon carbide, cubic boron nitride, diamond, and diamond-like graphite.

7. The rotary cone rock bit as recited in claim 5 wherein the average particle size of the low friction wear resistant material is in the range of from about 0.001 to 0.2 millimeters.

8. The rotary cone rock bit as recited in claim 5 wherein the elastomeric composition comprises in the range of from 10 to 15 parts by weight of the wear resistant particles per 100 parts by weight of the elastomeric composition.

9. A rotary cone rock bit for drilling subterranean formations comprising:

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces;

a dynamic O-ring seal interposed between the cone and the journal pin for retaining the grease in the bearing comprising:

a body formed from a resilient elastomeric matrix comprising an elastomeric material and a multiplicity of low friction wear resistant particles uniformly distributed throughout the matrix selected from the group consisting of soft metals, hard metals, ceramic-metal composites, and ceramics; and a surface comprising an array of such low friction wear resistant particles exposed at the surface by wear of the elastomeric matrix, forming wear pads for contacting adjacent surfaces of the journal pin and the cone.

10. The rotary cone rock bit as recited in claim 9 wherein the low friction wear resistant particles are selected from the group of materials consisting of titanium carbide, cemented tungsten carbide, cubic boron nitride, diamond, diamond-like graphite, and silicon carbide.

11. The rotary cone rock bit as recited in claim 10 wherein the low friction wear resistant particles have an average particle size in the range of from 0.001 to 0.2 millimeters.

12. The rotary cone rock bit as recited in claim 11 wherein the elastomeric matrix comprises in the range of from 10 to 15 parts by weight of the low friction wear resistant particles per 100 parts of the elastomeric material.

13. The rotary cone rock bit as recited in claim 12 wherein the low friction wear resistant particles are rounded or non-rounded.

* * * * *